United States Patent [19]

Kii

[11] 4,253,002

[45] Feb. 24, 1981

[54] SELF-EXTINGUISHING TYPE CIRCUIT INTERRUPTER

[75] Inventor: Masami Kii, Amagasaki, Japan

[73] Assignee: Mitsubishi Denki Kabushiki Kaisha, Japan

[21] Appl. No.: 889,553

[22] Filed: Mar. 23, 1978

[30] Foreign Application Priority Data

Mar. 24, 1977 [JP] Japan ..... 52/32899
Mar. 24, 1977 [JP] Japan ..... 52/32906

[51] Int. Cl.[3] ..... H01H 33/70

[52] U.S. Cl. ..... 200/148 R; 200/148 A; 200/150 D

[58] Field of Search ..... 200/148 A, 150 D, 150 G, 200/148 R

[56] References Cited

U.S. PATENT DOCUMENTS

| | | | |
|---|---|---|---|
| 2,061,945 | 11/1936 | Koppelmann et al. | 200/150 G |
| 2,442,010 | 3/1948 | Leeds et al. | 200/150 G |
| 4,139,752 | 2/1979 | Itai et al. | 200/148 R |

FOREIGN PATENT DOCUMENTS

| | | | |
|---|---|---|---|
| 695436 | 8/1940 | Fed. Rep. of Germany | 200/150 D |
| 47-29345 | 12/1972 | Japan | 200/148 B |
| 49-42465 | 4/1974 | Japan | 200/148 B |

*Primary Examiner*—J. V. Truhe
*Assistant Examiner*—Morris Ginsburg
*Attorney, Agent, or Firm*—Robert E. Burns; Emmanuel J. Lobato; Bruce L. Adams

[57] ABSTRACT

A circuit interrupter comprising a first and a second chamber both containng an arc extinguishing gas such as $SF_6$ gas, each chamber defining a space independent of the other when a pair of contacts is closed. Between the first and second chambers a movable piston member is disposed for transmitting a pressure from the first chamber to the second chamber. When the arc extinguishing fluid in the first chamber is pressure-raised by the energy of an electric arc established between the contacts at their initial separation stage, the movable piston member is moved to compress the arc extinguishing fluid within second chamber. The arc extinguishing fluid thus compressed is puffed at the electric arc to extinguish it.

5 Claims, 4 Drawing Figures

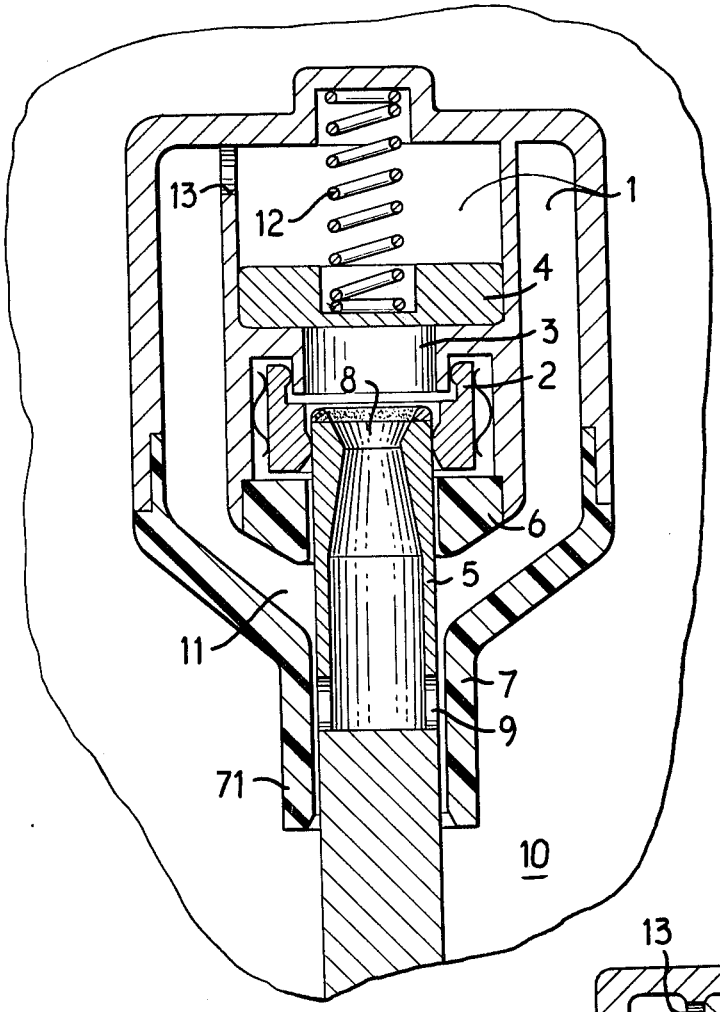
FIG. 1
FIG. 2
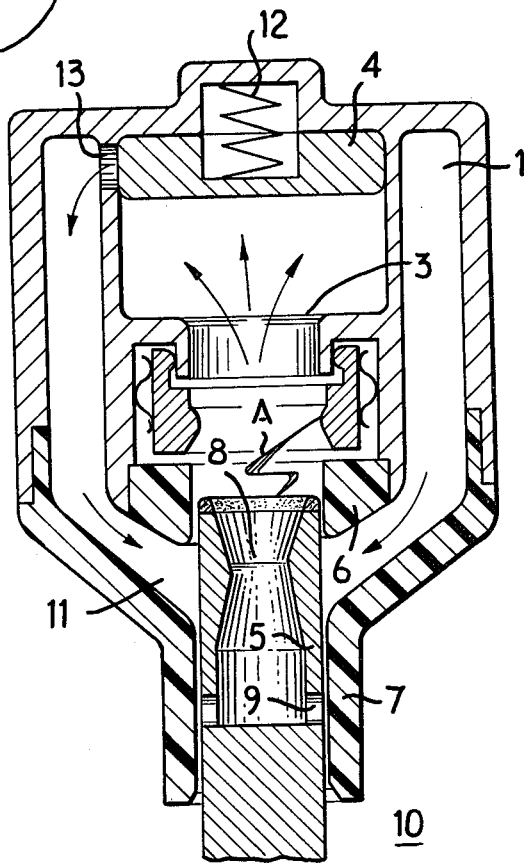

SELF-EXTINGUISHING TYPE CIRCUIT INTERRUPTER

BACKGROUND OF THE INVENTION

1. Field of the Invention

This invention relates to circuit interrupters wherein an arc extinguishing fluid such as $SF_6$ gas is utilized to extinguish an electric arc.

2. Description of the Prior Art

It has been a common practice in circuit interrupters using a gas having a strong arc extinguishing capability such as $SF_6$ gas to generate a pressure difference in the gas by a suitable means and to puff the high pressure gas to the electric arc to be extinguished, thereby effecting current interruption. There has been known two types of means for establishing the above mentioned pressure difference.

One type of circuit interrupter known as the double pressure type comprises a gas filled at a predetermined pressure within a casing in which $SF_6$ gas is also filled and a separate pressure generating apparatus for generating a high pressure, thereby obtaining the necessary pressure difference for generating a flow of the gas for arc extinction. Upon interruption, a valve disposed between the high pressure gas and the low pressure gas is opened in response to a contact opening operation to allow the high pressure gas to flow toward the arc, thereby blowing out the electric arc. With this type of circuit interrupter, the pressure generating apparatus for generating a high pressure and maintaining it and two pressure systems for high and low pressure gases are separately constructed, so that the overall structure of the interrupter is extremely complicated and large, rendering it uneconomical. Besides, it is disadvantageous from a practical view point in that the high pressure of the gas must always be maintained.

The second type of circuit interrupter is known as a single pressure puffer-type wherein a puffer device disposed within a gas of a few atmospheres pressure contained in a sealed casing is operated in response to the interrupting operation to generate a high pressure gas, which gas is then puffed to the electric arc to extinguish it. This type of circuit interrupter utilizes compressed gas of a pressure lower than that used in the double pressure type, so that designing of a practical casing structure is easier. However, the circuit interrupter requires a mechanical pressure generating device such as a puffer device operable in response to the interrupting operation. The puffer device requires a stronger driving force for a higher input electrical power and a higher interrupting current, inevitably resulting in the requirement for a powerful operating mechanism in a large capacity circuit interrupter. It is also proposed to assist the large operating mechanism with an electromagnetically operated puffer device, but this operating mechanism is also disadvantageous in that it is large-sized, complicated in structure, not economical and not practical.

SUMMARY OF THE INVENTION

Accordingly, the chief object of the present invention is to provide a circuit interrupter operable with a small operating force and small in size.

With the above object in view, the present invention resides in a circuit interrupter comprising a first chamber for raising the pressure of an arc extinguishing fluid and a second chamber, independent of the first chamber when separable electrical contacts are closed, also containing the arc extinguishing fluid. The pressure of the arc extinguishing fluid in the second chamber is indirectly raised by the pressure-raising function of the arc energy at the initial stage of the contact opening operation. The pressure-raised arc extinguishing fluid in the second chamber, which is substantially at room temperature because substantially no thermal effect is applied thereto, is puffed at an electric arc established between the separated contacts, thereby enabling complete arc extinction. The circuit interrupter is constructed to raise the pressure of the arc extinguishing fluid by utilizing the arc energy, making it advantageous in that the necessary operating force does not vary irrespective of the load, the operating force is greatly decreased, and the resulting interrupter is small-sized and of high performance.

BRIEF DESCRIPTION OF THE DRAWINGS

FIG. 1 is a schematic sectional view illustrating the arc extinguishing chamber of a circuit interrupter embodying the present invention in its closed position;

FIG. 2 is a schematic sectional view of the interrupter shown in FIG. 1 illustrating it in its position in which the pressure has been raised at the initial stage of the contact open operation;

DESCRIPTION OF THE PREFERRED EMBODIMENTS

Figure 3:
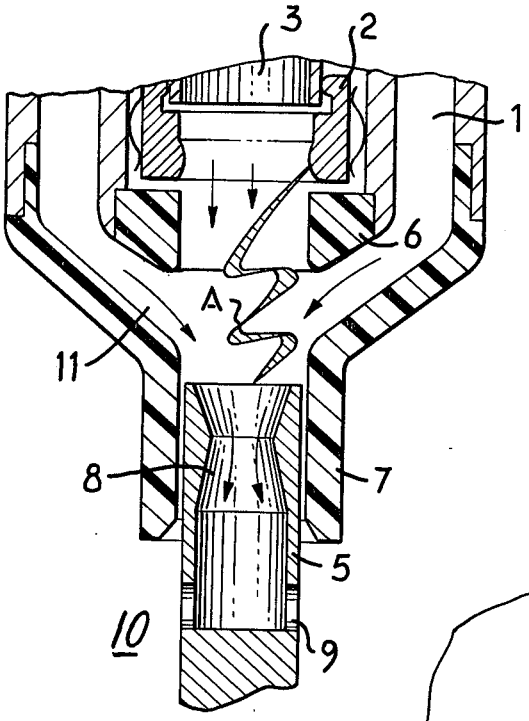
FIG. 3 is a schematic sectional view of the interrupter shown in FIG. 1 illustrating it in the position in which the pressure-raised arc extinguishing fluid is applied to an electric arc at the later stage of the contact opening operation.

Referring now to the drawings and in particular to FIG. 1 thereof, a circuit interrupter of the present invention comprises a casing containing a second chamber 1 containing an arc extinguishing fluid, and a first chamber 3 having disposed therein a stationary contact 2 and communicating with an arcing region for generating a high pressure. Between the first chamber 3 and the second chamber 1, a movable member 4 such as a piston is disposed. As viewed from the figure, the lower face of the movable member 4 is directed to the first chamber 3 and the upper face is directed to the second chamber 1, and the movable member 4 is movable in the up and down directions. The arc extinguishing fluid is filled also into the first chamber 3. The movable contact 5 is capable of contacting and separating from the stationary contact 2. When the contacts are closed, an opening 11 in the second chamber communicating with the arcing region is substantially closed by the movable contact 5, thereby assisting the pressure-raising in the second chamber 1. For a short period of time after separation of the contacts 2 and 5, the first chamber 3 is substantially closed by the insulating member 6, facilitating pressure-raising at a higher rate and to a higher value. In order to increase this effect, the insulating member 6 is made of an insulating material having a good arc resisting property such as Teflon (Trade Mark). A flow guide 7 made of an insulating material and forming an orifice together with the insulating member 6 has a portion thereof formed into a conical configuration in order to effectively flow the fluid in the second chamber 1 into a nozzle 8 formed in the movable contact 5. The lower end of the conical shape terminates at a straight cylindrical portion 71 for closing the opening 9 formed in the lower end of the nozzle 8 for a predetermined period of time to increase the pressure in the second chamber 1, and then opening it to the surrounding chamber 10. A compression spring 12 is disposed for biasing the movable member 4 toward the first chamber 3.

With the circuit interrupter as above described, when the operating mechanism (not shown) is driven by a trip command, the movable contact 5 moves downward to cover a predetermined wiping distance to separate from the stationary contact 2, thereby establishing an electric arc between the stationary contact 2 and the movable contact 5, resulting in an increase in pressure in the first chamber 3. This pressure acts upon the lower face of the movable member 4 to rapidly move it upward against the spring force of the compression spring 12 as viewed from FIG. 2. This upward movement of the movable member 4 rapidly increases the pressure within the second chamber 1 which includes the space above the movable member 4 and the surrounding space. This occurs because, when the movable member 4 moves upward, the pressure within the portion of the second chamber 1 above the movable member 4 rises, and this pressure rise immediately propagates through the passage 13 to the surrounding portion of the second chamber 1. Further downward movement of the movable contact 5 causes the opening 9 to open to the surrounding chamber 10 within the casing with a little delay after the opening of the nozzle 8 to the second chamber 1 as illustrated in FIG. 3. When the current reaches the zero point, the arc A is extinguished by the strong blasting and diffusing function of the high pressure arc extinguishing fluid stored within the second chamber 1. Since the high pressure fluid in the second chamber 1 is isolated from the arcing region, the high temperature fluid including its dissociation products does not directly flow thereinto, ensuring that the fluid has a very good arc extinguishing capability comparable to the case of an ordinary puffer-type circuit interrupter. That is, during the further downward movement of the movable contact 5 after the opening 9 is communicated with the surrounding chamber 10, the second chamber 1 is in a state similar to the case of the puffer-type interrupter. It is to be noted that the circuit interrupter illustrated in FIGS. 1 to 3 utilizes the arc extinguishing fluid contained in the first chamber 3 for the extinction of the arc.

Figure 4:
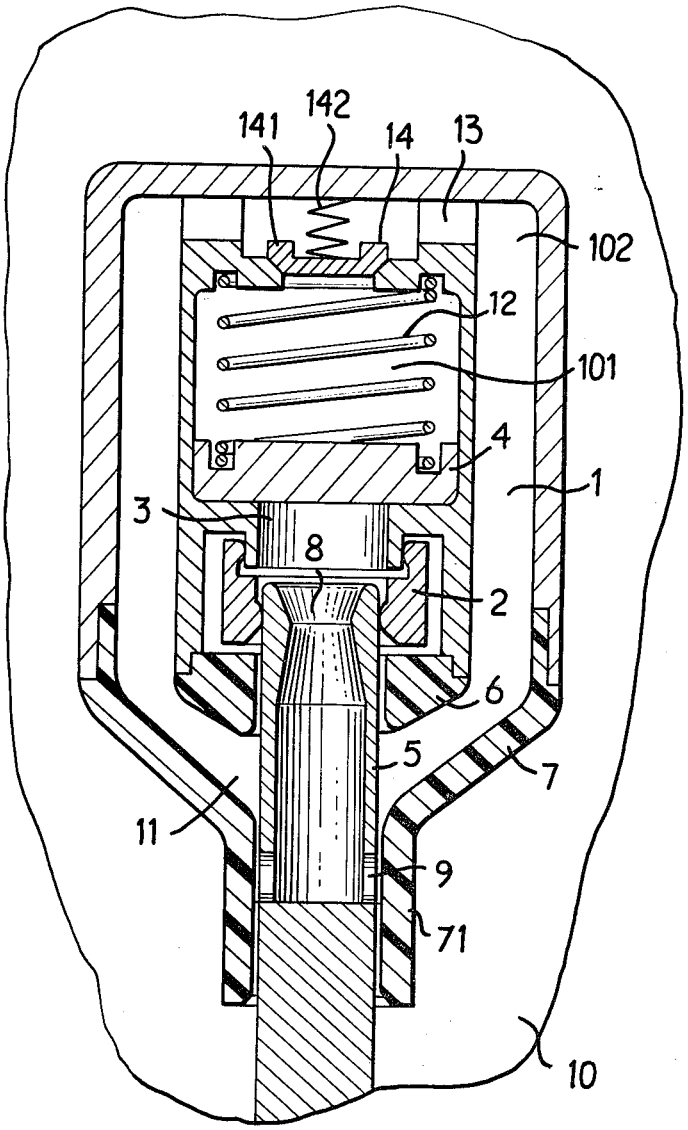
FIG. 4 is a schematic sectional view showing another embodiment of the present invention having a check valve.

FIG. 4 illustrates another circuit interrupter embodying the present invention. In the illustrated circuit interrupter, the second chamber 1 is divided by a check valve 14 into a space 101 contacting the movable member 4 and a space 102 communicating to the opening 11. The space 101 serves as a reservoir for the arc extinguishing fluid. The pressure relief valve 14 comprises a valve 141 and a compression spring 142 for biasing the valve 141 downward as viewed from the figure. The pressure relief valve 14 is arranged to open when the pressure of the arc extinguishing fluid in the space 101 is compressed above the predetermined value by the movement of the movable member 4 to allow the arc extinguishing fluid to flow toward the opening 11.

When a trip command is given to the unillustrated operating mechanism, it moves the movable contact 5 downward, thereby establishing an electric arc and rapidly increasing the pressure of the arc extinguishing fluid in the first chamber 3 in a similar manner to the circuit interrupter shown in FIG. 1. The pressure acts upon the lower face of the movable member 4 to rapidly move it upward against the spring force of the compression spring 12. The arc extinguishing fluid within the space 101 is then supplied through the pressure relief valve 14 and the passage 13 into the outer space 102 of the second chamber 1, so that the pressure in the second chamber 1 is increased in conjunction with the amount of the arc extinguishing fluid supplied from the space 101 into the outer space 102 of the second chamber 1. It is to be noted that the increased pressure is sufficiently high for effecting an effective arc extinction.

About the time at which the nozzle 8 is caused to communicate with the second chamber 1 by a further downward movement of the movable contact 5, the opening 9 is also opened to the surrounding chamber 10 within the casing. Under these circumstances, when the arc current reaches the zero value, the high pressure fluid in the second chamber 1 is released through the nozzle 8 to the surrounding chamber 10 defined by the casing, whereby the electric arc is extinguished by the powerful diffusing and cooling function of the high pressure fluid. If the arc current continues to flow even with the movable contact 5 in the above described further down position, the arc extinguishing fluid in the second chamber 1 is directly pressure-raised by the arc because no reverse flow into the space 101 is allowed by the pressure relief valve 14. When the arc current decreases under these circumstances, since the arc inner pressure also rapidly decreases, the high pressure fluid in the second chamber 1 is puffed at the arc to extinguish it.

Although the present invention has been described in terms of particular embodiments, many modifications and changes may be made without departing from the scope and the spirit of the present invention.

What is claimed is:

1. A self-extinguishing circuit interrupter, comprising:

a casing having an interior space for containing in use an arc extinguishing fluid;

means for defining a first chamber within said casing and containing in use an arc extinguishing fluid, said first chamber having an opening therethrough;

means for defining a second chamber disposed adjacent to said first chamber with said first chamber opening into said second chamber, and said second chamber having an opening therethrough aligned with the opening through said first chamber;

a pair of separable contact members disposed within said first chamber, at least one of said contact members movable and dimensioned to extend through said openings of said first and second chambers and into said first chamber; and means, including a movable member disposed between said first and second chambers and movable to vary the internal volume of said second chamber while maintaining a substantially fluid tight relationship between said first and second chambers, for transmitting the pressure of said arc extinguishing fluid within said first chamber, raised by an arc established between separated contact members, to said second chamber.

2. A circuit interrupter as claimed in claim 1, further comprising means, disposed in said movable contact member, for blocking, in cooperation with said first chamber defining means, fluid communication from said first and second chambers to said interior space of the casing until the contact members separate a predetermined distance from each other, and for establishing said fluid communication when the contact members separate beyond said predetermined distance during the separation of the contact members.

3. A circuit interrupter as claimed in claim 1 or 2, wherein said pressure transmitting means comprises a piston cylinder having one end in communication with said first chamber and having the other end in communication with said second chamber, and said movable member being a piston disposed and movable within said cylinder.

4. A circuit interrupter as claimed in claim 3, wherein said pressure transmitting means further comprises bias means for biasing said movable piston toward said first pressure chamber.

5. A circuit interrupter as claimed in claim 3, further comprising pressure release valve means disposed at said other end of said piston cylinder for allowing the arc extinguishing fluid within said piston cylinder to release into said second chamber when the pressure of said arc extinguishing fluid within said piston cylinder compressed due to the movement of said movable piston exceeds a predetermined value.

* * * * *